US005562237A

United States Patent [19]

Saliaris

[11] Patent Number: 5,562,237

[45] Date of Patent: Oct. 8, 1996

[54] TROUSERS HANGER

[76] Inventor: George P. Saliaris, 215 Indian Run Dr., Dublin, Ohio 43017

[21] Appl. No.: 446,467

[22] Filed: May 22, 1995

[51] Int. Cl.[6] ..... A47G 25/50

[52] U.S. Cl. ..... 223/96; 223/85; 223/95

[58] Field of Search ..... 223/95, 96, 93, 223/91, 90, 85; D6/315, 326, 327, 317

[56] References Cited

U.S. PATENT DOCUMENTS

| | | | |
|---|---|---|---|
| D. 171,872 | 3/1954 | Waldron et al. . | |
| D. 243,991 | 4/1977 | Schmidt, Jr. . | |
| D. 278,867 | 5/1985 | Tendrup et al. . | |
| D. 343,300 | 1/1994 | Doyel | D6/327 |
| 2,547,561 | 4/1951 | Brooke | 223/96 |
| 2,998,173 | 8/1961 | Lutz | 223/96 |
| 4,632,286 | 12/1986 | Koyama . | |
| 5,074,447 | 12/1991 | Kolton et al. | 223/DIG. 1 |
| 5,236,109 | 8/1993 | Zuckerman | 223/96 |
| 5,361,949 | 11/1994 | Petrou | 223/96 |

*Primary Examiner*—Bibhu Mohanty
*Attorney, Agent, or Firm*—Francis T. Kremblas, Jr.

[57] ABSTRACT

A trousers hanger of the type having two integrally formed legs disposed at an acute angle which form an open end through which trousers can be easily mounted over one leg of the hanger. The other side of the hanger includes a hook end adapted to permit the hanger to be hung from a clothing rod or the like. The lower leg which accepts a pair of trousers includes a pair of spaced, linearly extending gripping bars overlying significant length portions of the lower leg and are resiliently biased in a closely spaced relationship to an upper edge of the lower ledge for engaging a pair of trousers placed between the gripping bars and lower leg in a manner which tends to hold the trousers in a slightly taunt, unwrinkled condition. The confronting inner ends of each gripping bar are spaced from one another and include an upturned edge to facilitate mounting an edge of the trousers under each gripping bar.

2 Claims, 6 Drawing Sheets

TROUSERS HANGER

TECHNICAL FIELD

The present invention relates generally to garment hangers and particularly to an improved trouser hanger of the type having an open end to make mounting and dismounting of the trousers easier than the conventional closed triangular hanger configuration.

BACKGROUND ART

Many prior art designs for hangers to mount a pair of trousers in a secure and unwrinkled condition have been attempted over the past several decades. The conventional closed triangular shape, which includes the ability to hang both a coat and pair of trousers, has the disadvantage of being somewhat more difficult to mount the pair of trousers in a facile manner. Therefore several attempts have been made by those skilled in the art to design a two-sided hanger to accommodate only a pair of trousers having an open end to allow easier mounting and dismounting of the trousers. However, this open end design which permits easier mounting also required means to prevent the trousers from falling off the open end of the hanger or to slide toward the closed end into a wrinkled condition if the hanger becomes inclined in one direction or the other.

Examples of various prior art designs of the open ended type trousers hanger are found in prior U.S. Pat. Design Nos. 243,991; 171,872; 278,867; and French Pat. No. 1,145,021. U.S. Pat. No. 4,632,286 is an example of a combination coat and open ended trouser hanger attempting to accommodate the hanging of a suit coat and matching trousers in a single device.

In an attempt to overcome the drawback of the trousers slipping or sliding toward one end of a hanger having an open end, various structural features were introduced to better secure the trousers in the intended disposition.

These features included a turned up portion on the horizontal bar portion at the open end and structures forming a clamp to grip one portion of the trousers disposed on the horizontal bar portion. However, these prior art structures suffer certain disadvantages and fail to accommodate in a more satisfactory manner the object of providing ease of mounting and dismounting the trousers while securing them in a wrinkle-free condition on the hanger.

BRIEF DISCLOSURE OF THE INVENTION

The present invention relates to a trousers hanger of the type having two sides formed by leg portions integrally connected to one another to form an acute angle which include an open end through which trousers can be more easily mounted and dismounted from the hanger. More particularly the present invention comprises an improvement in the manner of mounting and dismounting the trousers including means to releasably secure the trousers in the desired position on the hanger in a wrinkle-free condition.

In general, the trousers hanger of the present invention includes an integrally formed pair of leg portions disposed at an acute angle relative to one another. An upper leg portion includes a curved, hook-like end adapted to engage a conventional horizontally disposed clothing hanging rod, such as found in a typical closet or other horizontally disposed hanging device, designed to receive a hanger. The lower leg portion extends in an essentially linear direction and is provided with a pair of resilient gripping or holding bars extending in overlying relationship over at least a substantial portion of the length of the lower leg portion. Each gripping bar terminates at confronting inner ends spaced to create a gap between the confronting inner ends near the central portion of the lower leg portion. The gripping bars preferably include a length portion disposed closely adjacent to the underlying lower leg portion to resiliently engage a portion of trousers disposed between the gripping bar and lower leg portion.

The inner ends of the gripping bars are turned or curved upwardly to facilitate sliding the opposing edges of the folded trousers between each gripping bar and the lower leg portion. A portion of the gripping bars are biasly disposed in a spaced relationship to the lower leg portion which is adapted to engage a substantial portion of the trousers against the lower leg portion.

The curved hook-like portion of the upper rod is adapted such that, when hung on a horizontal clothes rod, the weight of the trousers mounted on the lower arm will cause the hook-like portion to pivot to maintain the lower leg portion in a horizontal position.

DETAILED DESCRIPTION

Figure 1:
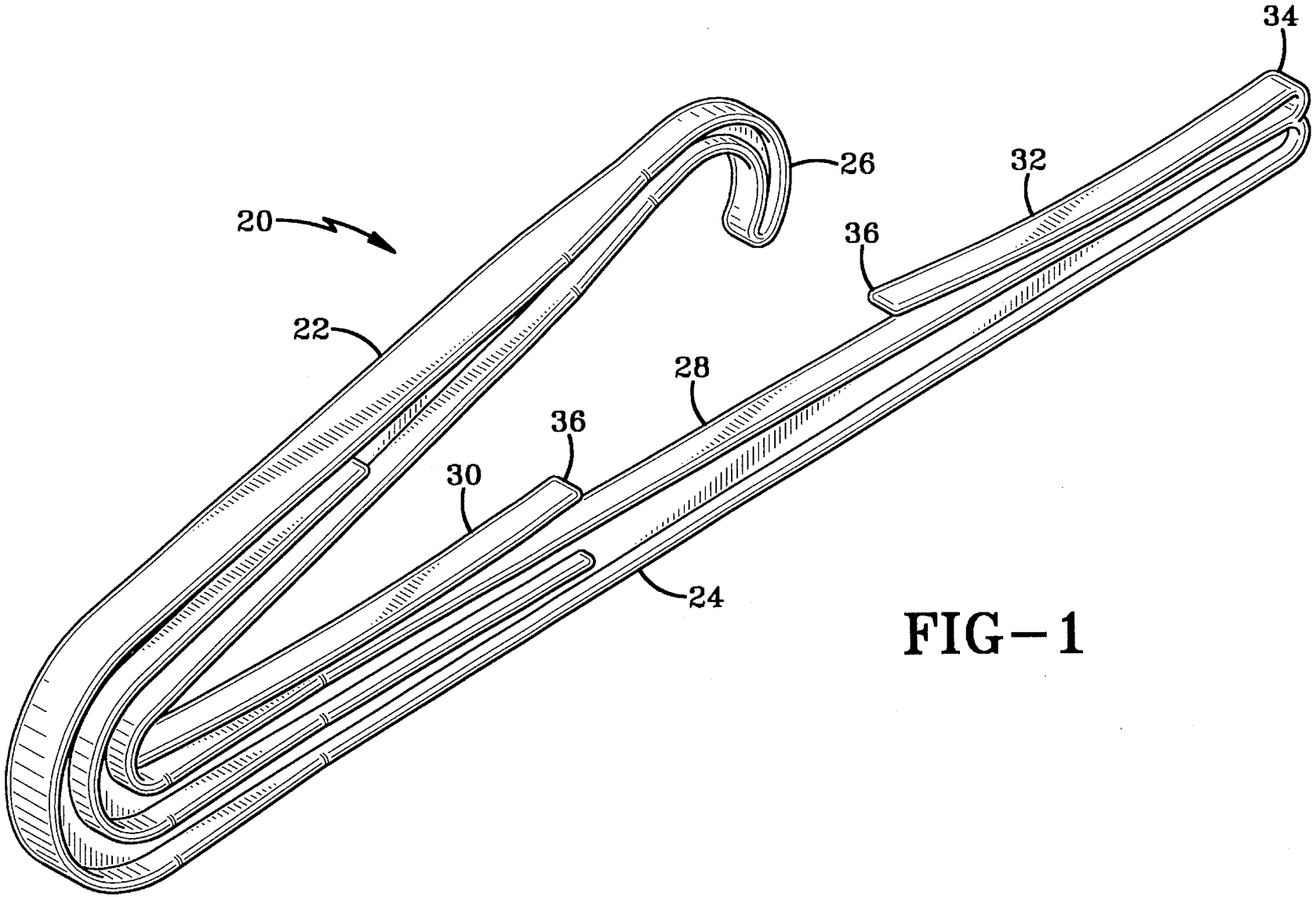
FIG. 1 is a perspective view of a trousers hanger constructed in accordance with the present invention.
Figure 2:
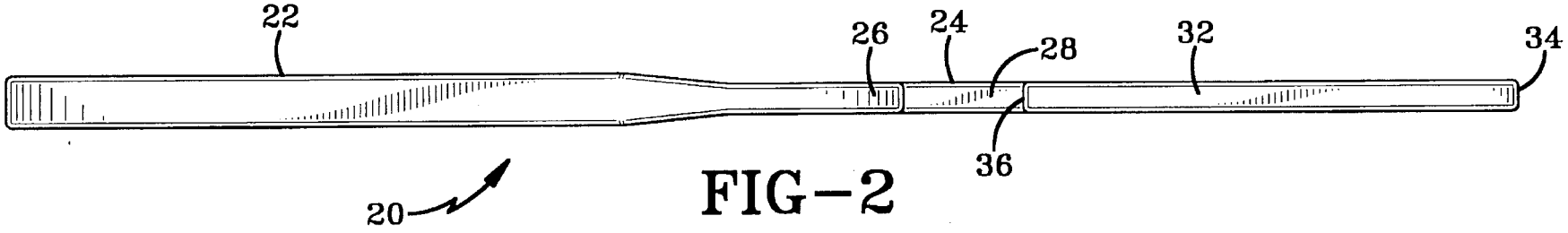
FIG. 2 is a top plan view of the trousers hanger shown in FIG. 1.
Figure 3:
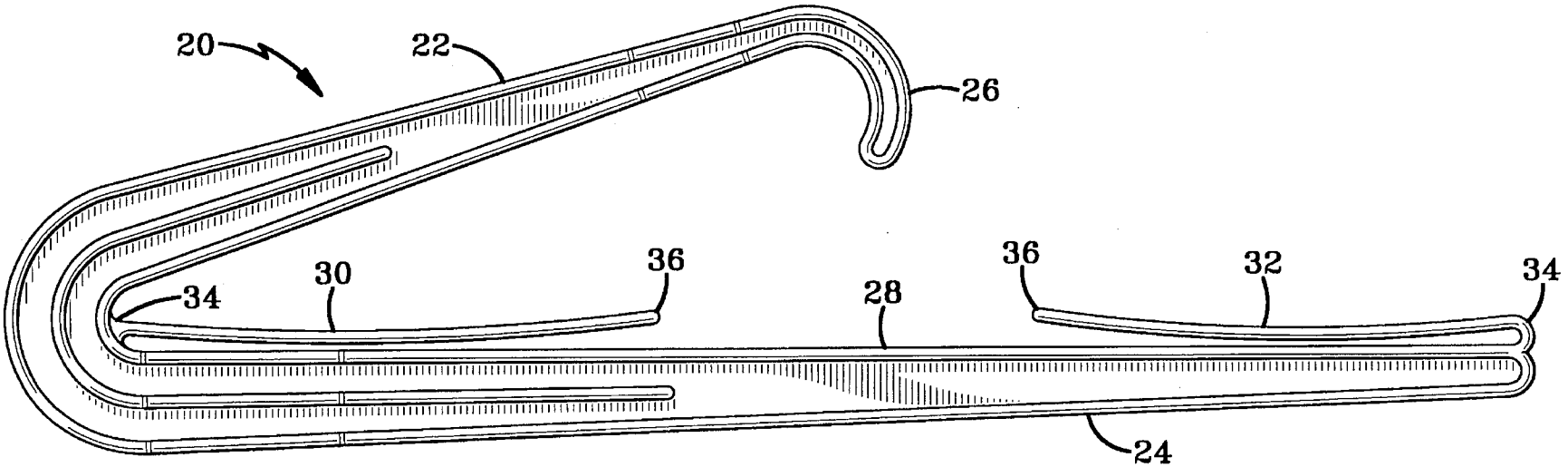
FIG. 3 is a front elevational view of the trousers hanger shown in the preceding figures, the rear view thereof being a mirror image.
Figure 4:
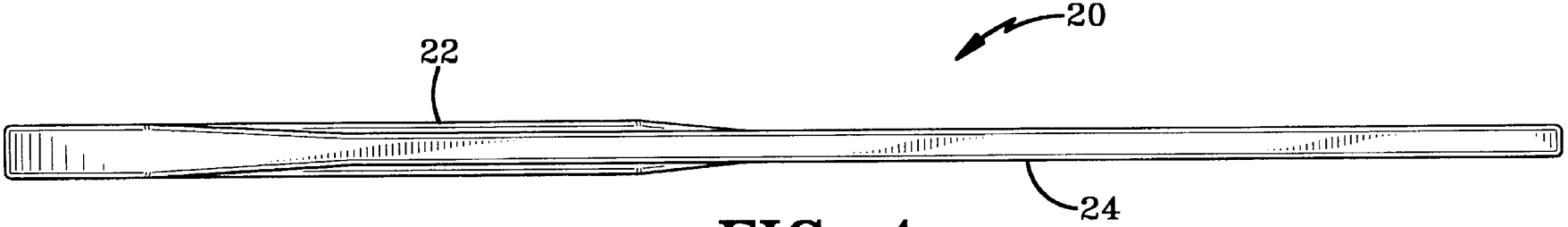
FIG. 4 is a bottom plan view of the trousers hanger shown in the preceding figures.
Figure 6:
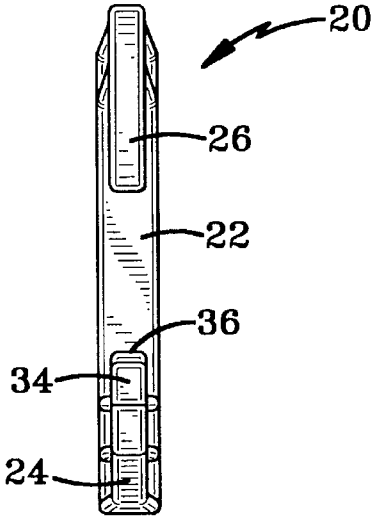
FIG. 6 is a right end elevational view of the trousers hanger shown in the preceding figures.
Figure 5:
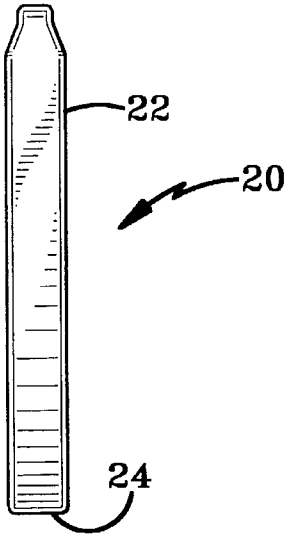
FIG. 5 is a left end elevational view of the trousers hanger shown in the preceding figures.

An improved trousers hanger, indicated generally at 20 and constructed in accordance with the present invention, is shown in FIGS. 1–6 and includes an upper leg portion 22 and a lower leg portion 24 integrally joined to one another to form an acute angle. Preferably, hanger 20 is made in one piece from a material such as plastic, for example, which is capable of being molded into the configuration shown in FIGS. 1–6. Injection molding is the preferred more economical method of manufacture Upper leg portion 22 includes a free end terminating in a curved shape forming a hook 26. The curvature of hook 26 is adapted to permit hanger 20 to pivot about a typical garment hanging bar, or other suitable horizontal support member, to a stable horizontal position, such as seen in FIG. 3 when a pair of trousers are folded over the central area of lower leg portion 24.

When the trousers are removed from their lower leg portion 24, hook 24 tends to pivot about a horizontal mounting rod due to the additional weight of the closed end which joins leg portions 22 and 24 causing the closed end to swing downwardly.

Lower leg portion 24 is provided with an upper edge having a smooth, even surface to enable a pair of trousers to slide easily over or along upper edge 28 without snagging and without introducing any creases or wrinkles in the trousers when hung over lower leg portion 24 between upper edge 28 and a pair of gripping bars 30 and 32.

Gripping bars 30 and 32 are preferably integrally formed as a part of the unitary hanger 20. Each bar 30 and 32 extend from opposing ends of lower leg 24 toward one another in close overlying relationship to lower leg portion 24. The bars 30 and 32 are fixed to lower leg portion 24 at their outer ends and have free inner end portions which are spaced from one another and include an upwardly turned or curved portion 36 forming an opening which allow the opposing edges of a pair of trousers to be easily inserted under a respective one of gripping bars 30 and 32 and over lower leg portion 24.

Each gripping bars 30 and 32 are resiliently biased in a normal closely spaced relationship relative to the upper edge 28 of lower leg portion 24 such that upon insertion of the opposing edges of a pair of trousers under a respective bars 30 or 32, the bar exerts a downwardly directed force upon the trousers against the upper edge 28. As best seen in FIG. 3, the generally central portion of each gripping bar 30 and 32 is provided with a downwardly curved length portion closer to upper edge 28 of lower leg 24 compared to the end portions 34 and 36. This central portion which is disposed closest to the upper edge 28 covers a significant length portion of each gripping bar 30 or 32, such as about one-third of each bars length dimension. Therefore a significant width portion of a pair of trousers is gently engaged between the gripping bars along upper edge 28 of lower led portion 24 at horizontally spaced locations.. This feature is important to adequately provide a sufficient holding force against the trousers to prevent their inadvertent movement in either direction on lower leg portion 24. Also, however, is very beneficial to distribute this holding force along a greater distance so as to reduce any tendency to create an unsightly crease or wrinkle in the trousers during the time the trousers are hung in position on hanger 20.

By providing a pair of opposing gripping bars, such as 30 and 32, spaced from one another to create a centrally disposed gap between them, the ease of mounting trousers folded over lower leg portion 24 is maintained. Further, the trousers are held at opposing, spaced positions, which allows the opposing edges of the trousers to be pulled into a slightly taut condition upon mounting the trousers. The trousers then tend to be securely held in a desirable unwrinkled condition by the spaced bias force applied by bars 30 and 32.

The amount of bias force applied to the trousers by gripping bars 30 and 32 at any single point along the length of the bars may be relatively lower since it is the cumulative force applied along a significant length of each bar 30 or 32 which tends to maintain the trousers in a desired condition against upper edge 28 of lower leg portion 24. This amount of force is desirably relatively low and preferably represents a balance between being sufficient to resist inadvertent movement of the trousers from the original desired mounted position over lower leg 24 and not so great so as to tend to create a crease in the trousers or make mounting or dismounting of the trousers difficult.

The provision of curved or upturned inner ends 36 of gripping bars 30 and 32 significantly facilitates initially inserting an edge of the trousers under each of the bars 30 and 32 and also facilitates any subsequent stretching of the trouser across their width to place them in a slightly taunt, unwrinkled condition.

With specific references to FIGS. 7–12, another preferred embodiment of the present invention is shown. The difference between the embodiment shown in FIGS. 7–12 and the embodiment shown in FIGS. 1–6 is merely in a modified construction of the gripping bars.

The components of the embodiment of FIGS. 7–12 which are of identical construction to the same components of FIGS. 1–6 will be identified by the same reference numeral followed by the designation "A". The modified components, specifically the gripping bars will be identified by new and different reference numerals relative to those used in FIGS. 1–6.

As seen in FIGS. 7–12, the trousers hanger, indicated generally at 20-A, includes an upper leg portion 22-A and a lower leg portion 24-A integrally joined to one another to form an acute angle. Hanger 20 preferably is made in one piece from suitable plastic material in the generally same manner as applicable to the embodiment of FIGS. 1–6 as previously described.

As earlier described in regard to the embodiment shown in FIGS. 1–6, upper leg portion 22-A includes a free end 26-A terminating in a curved, hook-like shape for the same purpose as priorly described herein.

Lower leg portion 24-A is provided with an upper edge 28-A having a smooth even surface for the same reasons as lower leg portion 22 as earlier described herein.

Figure 7:
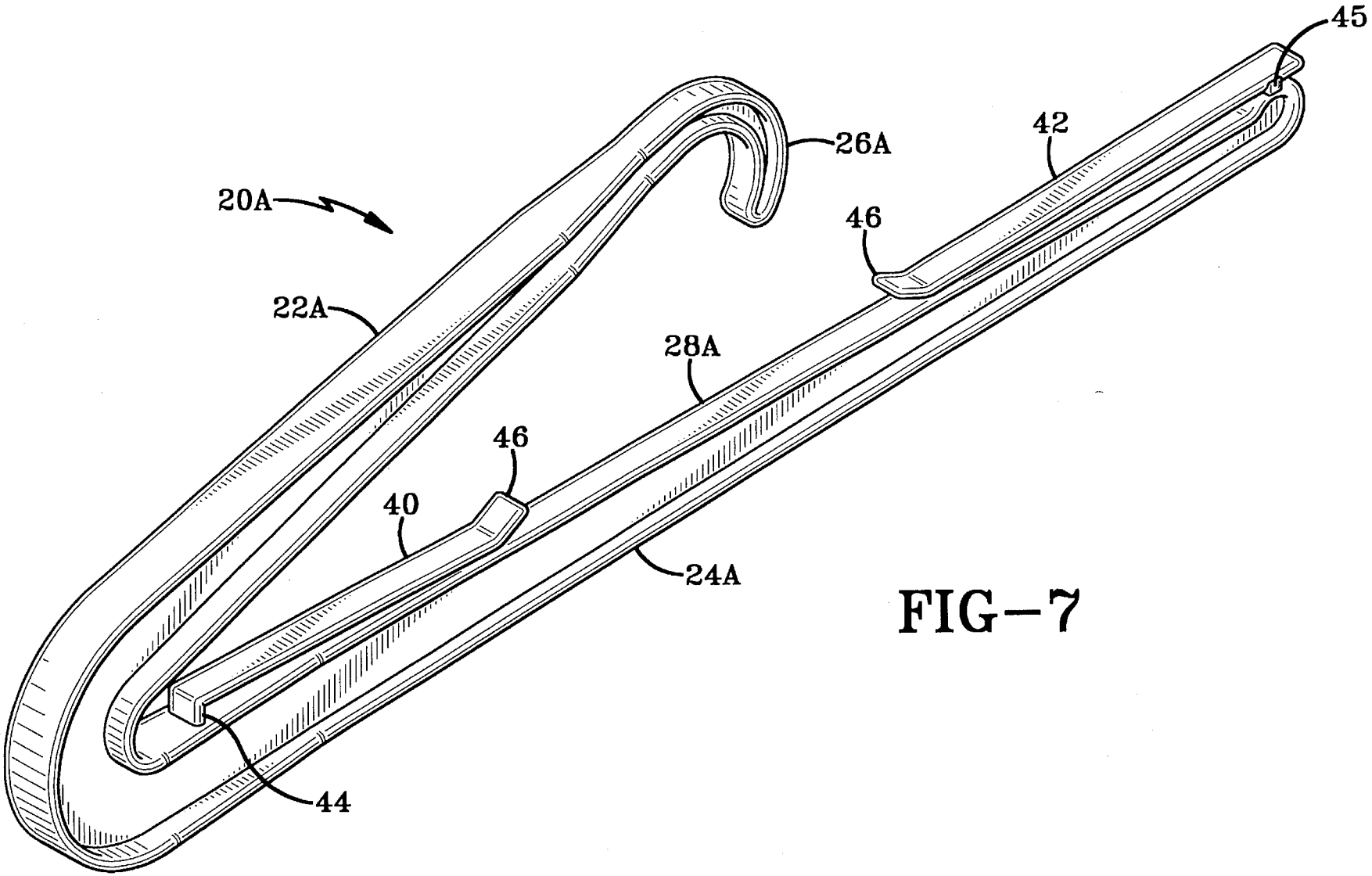
FIG. 7 is a perspective view of another preferred embodiment of a trousers hanger constructed in accordance with the present invention illustrating a modified form of the gripping members which overlie the lower leg portion of the hanger.
Figure 8:
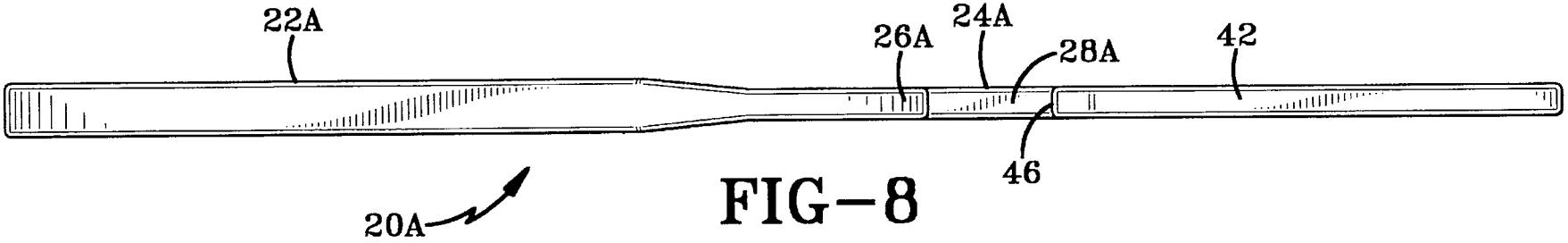
FIG. 8 is a top plan view of the trousers hanger shown in FIG. 7.
Figure 9:
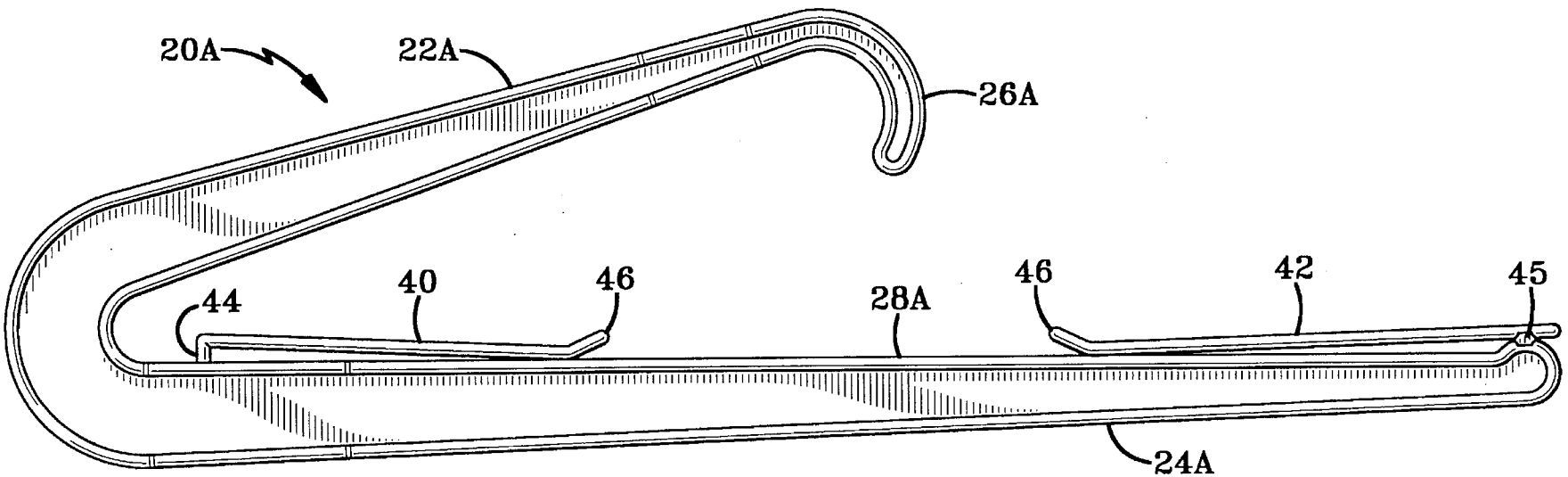
FIG. 9 is a front elevational view of the trousers hanger shown in FIG. 7, the rear view thereof being a mirror image.
Figure 10:
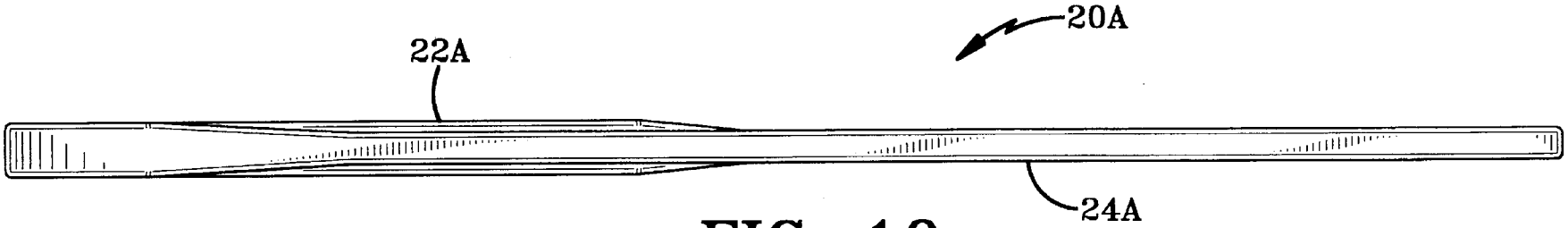
FIG. 10 is a bottom plan view of the trousers hanger shown in FIG. 7.
Figure 12:
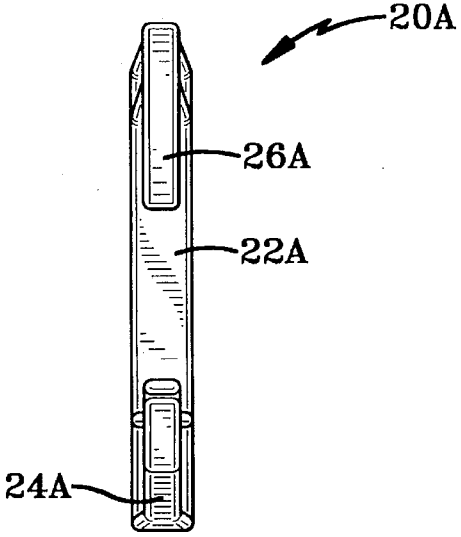
FIG. 12 is a right end elevational view of the trousers hanger shown in FIG. 7.
Figure 11:
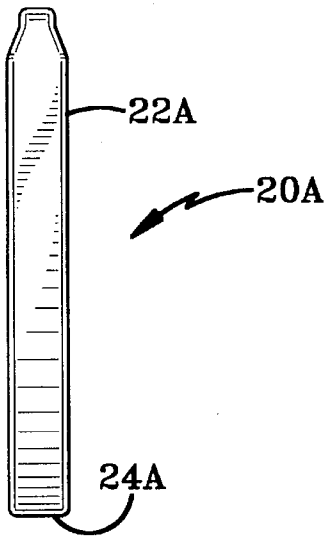
FIG. 11 is a left end elevational view of the trousers hanger shown in FIG. 7.

Gripping bars 40 and 42 of the embodiment shown in FIGS. 7–12 are modified in construction but perform the same function and purpose as gripping bars 30 and 32 as described in the embodiment shown in FIGS. 1–6. Each gripping bar 40 and 42 is resiliently biased in a normally closely spaced relationship relative to the upper edge 28-A, however, as best seen in FIG. 7, each gripping bar 40, 42 slopes downwardly from the respective ends 44, 45 toward a respective free inner end 46. Therefore, rather than the relatively gentle curved configuration of gripping bars 30 and 32 shown in FIGS. 1–6, gripping bars 40 and 42 are relatively straight but inclined downwardly to create a decreasingly close spaced relationship between each gripping bar and upper edge 28-A of lower leg 24-A.

It should also be noted that the free inner ends 46 of gripping bars 40 and 42 include an upturned configuration to create a significant opening to permit easy access for sliding the edge of a folded pair of trousers under a respective one of the gripping bars 40 and 42 in a very similar manner as earlier described in the embodiment of FIGS. 1–6 to accomplish essentially the same result.

It should be noted that the space between upper edge 28-A and the free end 46 of a respective gripping bar 40 or 42 gradually increases in a direction toward the closed or attached ends 44 and 45. Therefore a similarly significant length of each gripping bar 40 and 42 is available to engage a significant width portion of a pair of trousers positioned thereunder in a similar manner as described in the embodiment of FIGS. 1–6 and accomplishes the same advantageous function of lightly engaging the trousers without causing undesirable wrinkles or creases, yet secures them against sliding in either direction along upper edge 28-A. In the same manner as previously described, the trousers may be positioned in a slightly taut, unwrinkled condition on upper edge 28-A and held in that condition by the forces applied by each gripping bar at longitudinally spaced locations which are disposed toward each edge of the trousers folded over the lower leg 24-A.

Therefore, in all important respects, the embodiment of FIGS. 7–12 is essentially identical and equivalent in function to the embodiment of FIGS. 1–6.

I claim:

1. A trouser hanger comprising, in combination;

a) an upper leg portion having a first end and an opposing second end, said second end terminating in a curve forming a hook configured to be pivotally mounted on a horizontally disposed support member;

b) a generally linearly extending lower leg portion for supporting a pair of trousers folded over said lower leg portion, said lower leg portion being integrally formed with said upper leg portion to form an acute angle with one end connected to said first end of said upper leg portion and an opposing free end extending beyond the position of said hook formed on said upper leg portion; and c) a pair of gripping bars extending in overlying relationship along a preselected length of said lower leg portion, each of said gripping bars having one end fixed to said lower leg portion and a free end disposed in confronting, spaced relationship to the free end of the other gripping bar near a central portion of said lower leg portion and an intermediate length portion between their respective fixed and free ends, said intermediate length portion closely spaced and resiliently biased toward said lower leg portion to engage a portion of a pair of trousers disposed over said lower leg portion to stabilize said trousers upon said lower leg at spaced apart locations along the length of said lower leg portion, each of said free ends of said gripping bars including an upturned portion creating an opening freely accepting an edge of a pair of trousers for placement under said intermediate length portion of said gripping bar and over said lower leg portion.

2. The trouser hanger defined in claim 1 wherein the intermediate length portion biased to engage said trousers represents at least about one-third of the overlying length of the gripping bar relative to the lower leg portion.

* * * * *